US007641593B2

(12) United States Patent
Goulet

(10) Patent No.: US 7,641,593 B2
(45) Date of Patent: Jan. 5, 2010

(54) JUMP PIT FORM

(75) Inventor: Burt Goulet, Bloomville, NY (US)

(73) Assignee: Sportsfield Specialties, Inc., Delhi, NY (US)

( * ) Notice: Subject to any disclaimer, the term of this patent is extended or adjusted under 35 U.S.C. 154(b) by 670 days.

(21) Appl. No.: 11/406,200

(22) Filed: Apr. 18, 2006

(65) Prior Publication Data

US 2006/0252603 A1 Nov. 9, 2006

Related U.S. Application Data

(60) Provisional application No. 60/674,236, filed on Apr. 22, 2005.

(51) Int. Cl.
*A63B 5/00* (2006.01)

(52) U.S. Cl. ..... 482/15; 52/302.1; 52/302.3; 52/426; 52/169.1; 52/169.7

(58) Field of Classification Search ..... 482/15; 52/424–431, 302.1, 302.3, 169.1, 169.7, 52/169.8

See application file for complete search history.

(56) References Cited

U.S. PATENT DOCUMENTS 4,223,501 A * 9/1980 DeLozier ..... 52/426
4,882,882 A * 11/1989 Werner ..... 52/427

OTHER PUBLICATIONS

"Sand Pit Forms and Cover Systems," Gill Athletics, http://www.gillathletics.com/favilityCD/facilityCD_files/Page574.htm, 1-page, Apr. 24, 2007.

F440-29'-7" LJ TJ Sandpit Form with Sand Catcher Specifications; Gill Athletics, Champaign, IL, 9-pages, Oct. 22, 2004.

F420-29' LJ TJ Sandpit Form with Ledge Specification, Gill Athletics, Champaign, IL, 6-pages, Oct. 22, 2004.

F400-29' LJ TJ Sandpit Form Specifications, Gill Athletics, Champaign, IL, 6-pages, Oct. 22, 2004.

Cages and Inground Equipment, Section 2, Long Jump/Triple Jump Pit, Sand Catcher and Cover System, UCS Track & Field, Sports and Recreational Products, http://www.ec-securehost.com/UCSInc/Cages_and_Inground_Equipment_-_Section_2.html, 5-pages, Dec. 12, 2003.

Jump Pit Systems Brochure, Sports Edge, 8 pages, 2000.

NCAA and High School Long/Triple Jump Sand Pit with Sand Catchers and Cover Ledge, Sports Edge, Model Nos. SP6000, SP6010, SP6020, SP6012, SP6022, SP6014, SP6024, Cut Sheets and Installation Instructions, 17-pages, 2002.

Steeple Chase Water Jump Pit, Sports Edge, Model No. WJ5000, Cut Sheets and Installation Notes, 7-pages, 2002.

* cited by examiner

*Primary Examiner*—Richard E Chilcot, Jr.
*Assistant Examiner*—Matthew J Smith
(74) *Attorney, Agent, or Firm*—Heslin Rothenberg Farley & Mesiti

(57) ABSTRACT

A is provided for constructing a jump pit with a sand area. The form is constructed in sections. Each section has an inside wall and an outside wall. A support member is located between the outside wall and the inside wall. The sections are secured together onsite. Caps are mounted on the support members. The caps include an inclined surface which slops upwardly and away from the sand area forming the inclined surface. A cover over the sand area is supported by the inclined surface. Optionally, a chamber is located adjacent the outside wall. A grate covers the chamber and the grate is supported by a brace. A mat covers the grate. Openings in the grate and in the mat permit sand through them, thrown from the sand area to drop into the chamber.

14 Claims, 8 Drawing Sheets

JUMP PIT FORM

RELATED APPLICATIONS

This application claims priority based upon Provisional Patent Application, Ser. No. 60/674,236 filed on Apr. 22, 2005.

BACKGROUND OF THE INVENTION

1. Field of the Invention

This invention relates to forms and, most specifically, relates to forms for constructing jump pits used as a landing area for athletes.

2. Prior Art

Jump pits, which are well known in field sports, are used as a reasonably safe landing place in athletic activities for broad jumps and high jumps. Jump pits have specific standards and compliance with these standards is vital and critical.

In the past, forms were hand constructed onsite. Such hand constructed forms were frequently not accurate and thus failed to provide certainty of size. Obviously, hand construction is time consuming and thus expensive.

When an athlete lands in a jump pit which is filled with sand, sand from the sand pit is frequently thrown up in the air and outside of the jump pit itself. This results in loss of sand and creates a clean up situation. Therefore, it is most desirable that a sand pit or jump pit has an area surrounding the jump pit for rapidly reclaiming sand thrown from the jump pit. Athletic fields are used for a variety of events. Therefore, a jump pit and any associated sand recover area needs to be capable of being covered.

3. Objects

The objects of this invention are as follows:

1. To provide a jump pit form that is manufactured off site and is then readily assembled on site for construction of the jump pit.
2. To provide a jump pit form which remains part of the jump pit and is attractive.
3. To provide a form for constructing a jump pit that produces an accurate jump pit.
4. To provide a form for a jump pit that includes a sand catcher.
5. To provide the jump pit that is durable and economical.

These and other objects of the present invention will become readily apparent upon further review of the following specifications and drawings.

SUMMARY OF THE INVENTION

A jump pit form is provided for constructing a jump pit with a sand area which includes a base form having an inside wall and an outside wall. Support members are located between the outside wall and the inside wall. A cap is mounted on the support members, the cap having an inclined surface. A cover is supported by the inclined surface and covers the sand area.

BRIEF DESCRIPTION OF THE NUMERALS

| NUMERAL | DESCRIPTION |
|---|---|
| 21 | Base Form |
| 23 | Sections |
| 25 | Straight Sections |
| 27 | Corner Sections |
| 29 | Top |
| 31 | Inside Wall |
| 33 | Sand Area |
| 35 | Outside Wall |
| 36 | Interior Surfaces |
| 37 | Support Members |
| 39 | Short Part |
| 41 | Long Part |
| 43 | Short Side |
| 45 | Long Side |
| 47 | Vertical Channels |
| 49 | Cross Member |
| 51 | Three Large Circular Openings |
| 53 | Outside Panel |
| 54 | Top Panel |
| 55 | Interior Surface |
| 57 | Inside Panel |
| 59 | Interior Surface |
| 61 | Small Openings |
| 63 | Base Panel |
| 65 | Bottom |
| 67 | Wall Part |
| 69 | Top Part |
| 71 | Bottom Part |
| 73 | Vertical Lips |
| 75 | Sand Catcher |
| 77 | Cap |
| 79 | Cap Base |
| 81 | Inside Cap Wall |
| 83 | Support Surface |
| 85 | Cover |
| 87 | Outside Cap Wall |
| 88 | Flat Members |
| 89 | Synthetic Track Surface |
| 91 | Catcher Sections |
| 93 | Wall Cap |
| 95 | Chamber |
| 97 | Horizontal Bottom |
| 99 | Two Vertical Enclosures |
| 103 | Crushed Stone |
| 105 | Outside Vertical Enclosure |
| 107 | Inside Vertical Enclosure |
| 109 | Partial Cap |
| 111 | Inclined Surface |
| 113 | Brace |
| 114 | Grate |
| 116 | Mat |
| 118 | Opening |
| 121 | Bolt |
| 123 | Bar |
| 125 | Retainer |

-continued

| BRIEF DESCRIPTION OF THE NUMERALS | |
|---|---|
| NUMERAL | DESCRIPTION |
| 127 | Crushed Stone |
| 129 | Geotextile |

DETAILED DESCRIPTION OF THE PREFERRED EMBODIMENT

Figure 1:
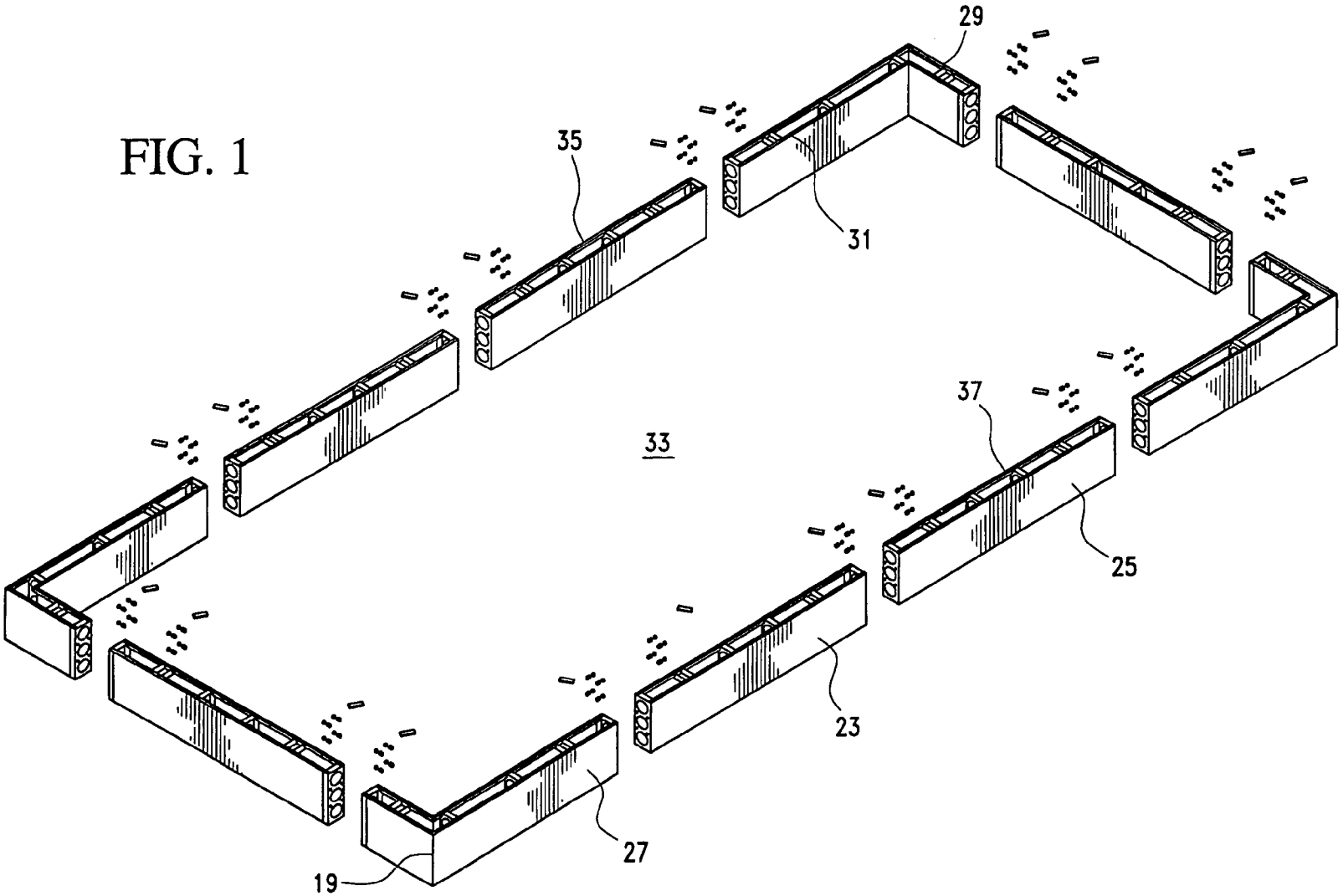
FIG. 1 is an exploded pictorial view of the base form for constructing a jump pit showing the individual sections used to construct the base form.

Referring now to FIG. 1, the base form 21 is shown. The base form 21, is prefabricated in sections 23, namely straight sections 25 and corner sections 27. The sections 23 are connected together and filled with cement. The top 29 of the base form 21 is located beneath the surface of an athletic field.

Both the corner sections 27 and the straight sections 25 have an inside wall 31, which is located toward the inside of the sand area 33 and an outside wall 35 facing away from the sand area 33. Both the outside wall 35 and the inside wall 31 have interior surfaces 36 between the outside wall 35, and the inside wall 31 where support members 37 are located. Support members 37 are secured to the outside wall 35 and to the inside wall 31, preferably by welding, but other means such as the use of bolts is also possible. The support members 37 are spaced from one another to assure that the inside wall 31, and the outside wall 35 neither bulges nor separates from one another in the placement of the cement between the outside wall 35 and the inside wall 31.

Figure 2:
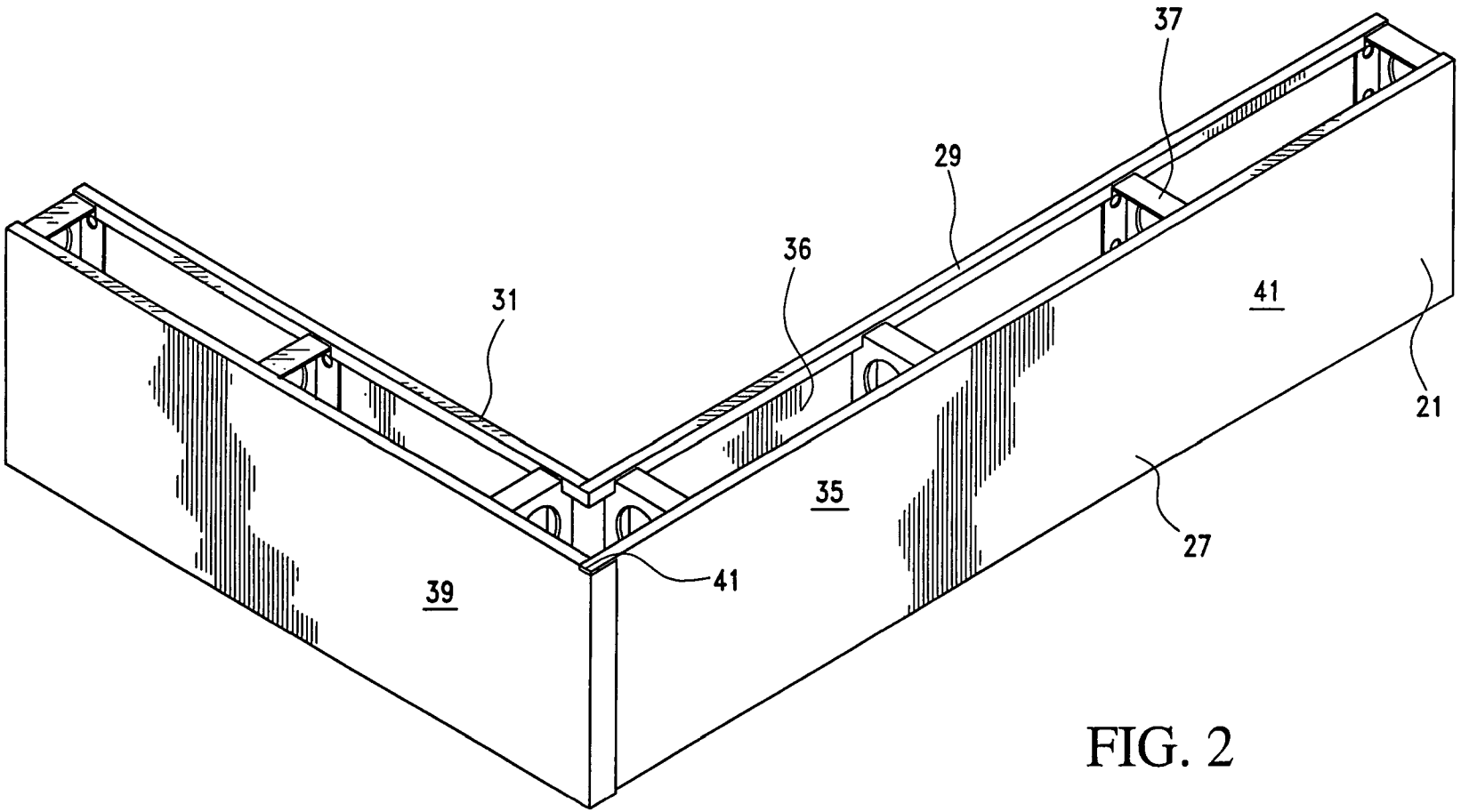
FIG. 2 is a perspective view of a corner of the form for the jump pit showing support members between the inside wall, and the outside wall of the form.

Referring now to FIG. 2, one corner, section 27 is shown. Each corner section 27 has a short part 39 and a long part 41. As seen in FIG. 1, the short part 39 is placed along the shorter side 43 of the base form 21, which has a rectangular cross section. The long part 41, therefore, is located along a long side 45 of the base form 21.

The shorter part 39 of each corner section of 27 is formed with vertical channels 41 in the corner section 27, both on the inside wall 31 and the outside wall 35 of the shorter part 39. The inside wall 31, and the outside wall 35 of the long part 41 slip fits into the respective vertical channel 47 in the short part 39, and is secured, preferably by welding.

Figure 4:
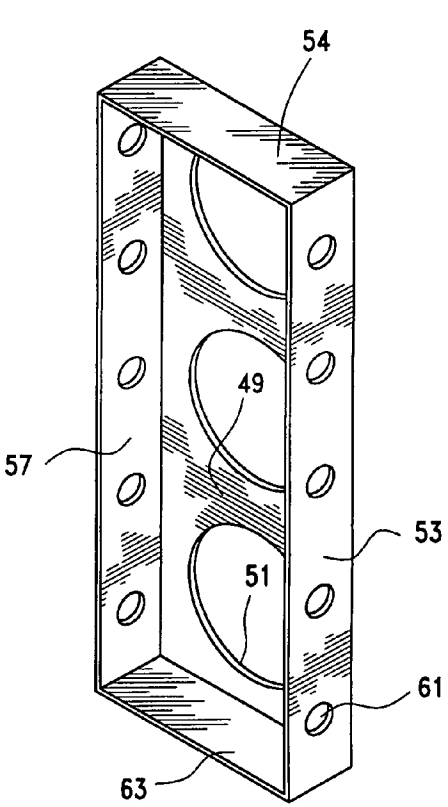
FIG. 4 is a pictorial view of a support member.
Figure 3B:
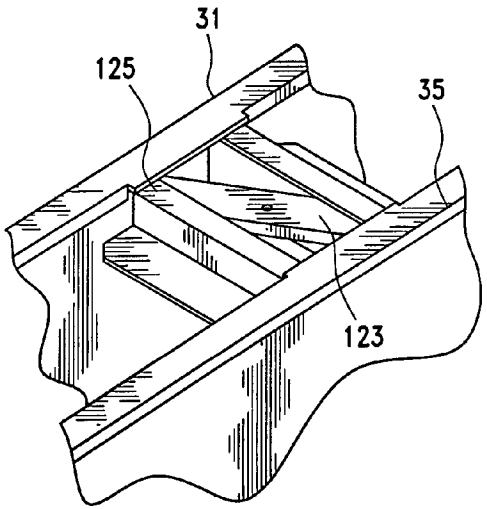
FIG. 3B is a pictorial view of a portion of the top of the base form showing a bar and a retainer with a threaded opening for bolting a cap and a sand catcher to the base form.
Figure 3A:
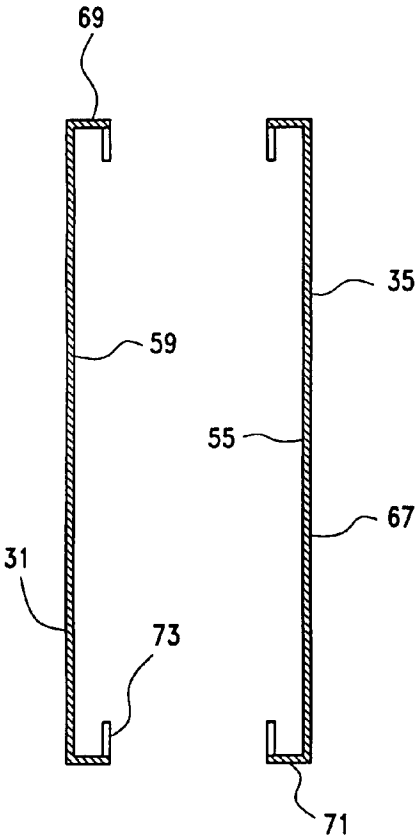
FIG. 3A is a cross-sectional view of the outside wall and the inside wall of the base form without a support member.

The support members 37 (FIG. 4) are formed from sheet metal, preferably aluminum, which is also preferably utilized for the inside wall 31 and the outside wall 35. Each support member 37 has a cross member 49 that extends from the outside wall 35 to the inside wall 31. The cross number 49 includes three large circular openings 51, which permit the poured cement to flow between the support members 37. Each support member 37 also has an outside panel 53, located substantially at a right angle to the cross member 49 and which is secured to the interior surface 55 of the outside wall 35. Each support member 37 also has a top panel 54 and an inside panel 57 which is located substantially at a right angle to the cross member 49, and which is secured to the interior surface 59 of the inside wall 31. Small openings 61 are located in the outside panel 53, and the inside panel 57. There is also a base panel 63 extending at the bottom of the base form 21 substantially at right angles from the cross member 49 and from the outside panel 53 and the inside panel 57. The top panel 54 extends from the top of the base form 21 substantially at right angles from the cross member 49 and from the outside panel 53 and the inside panel 57.

Both the inside wall 31 and the outside wall 35 have a wall part 67 and a top part 69 and bottom part 71. The top part 69 and the bottom part 71, are substantially at right angels to the inside wall 31 and the outside wall 35. Vertical lips 73 extend at a short distance from the top panel 69, and the bottom panel 71. The vertical lips 73 are notched to permit the support members 37 to be secured to the interior surfaces 55, 59, of the inside wall 31 and the outside wall 35.

Figure 3:
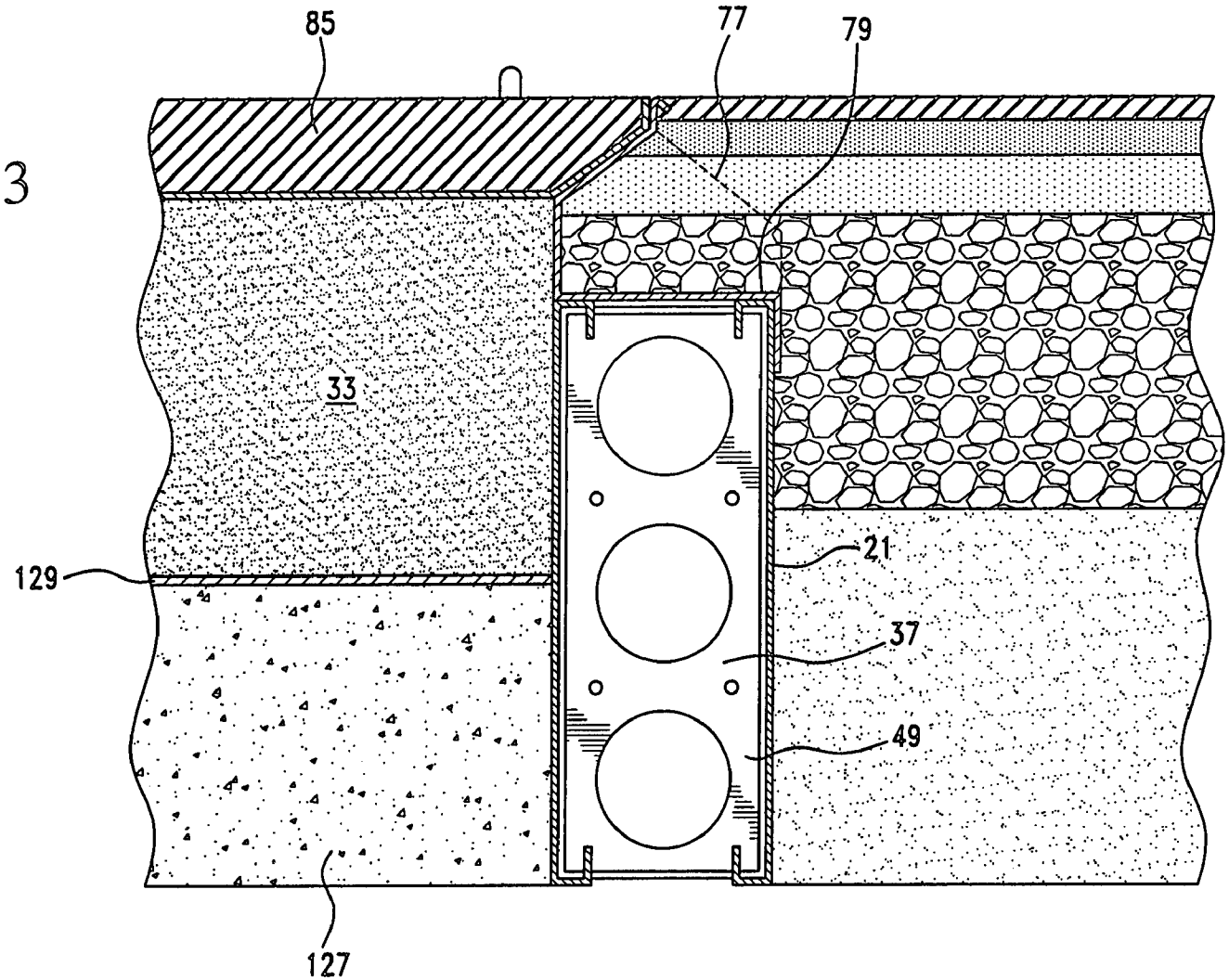
FIG. 3 is a cross-sectional view of the base form at a support member of the jump pit showing the support member with a cap on the wall but without any sand catcher.
Figure 5:
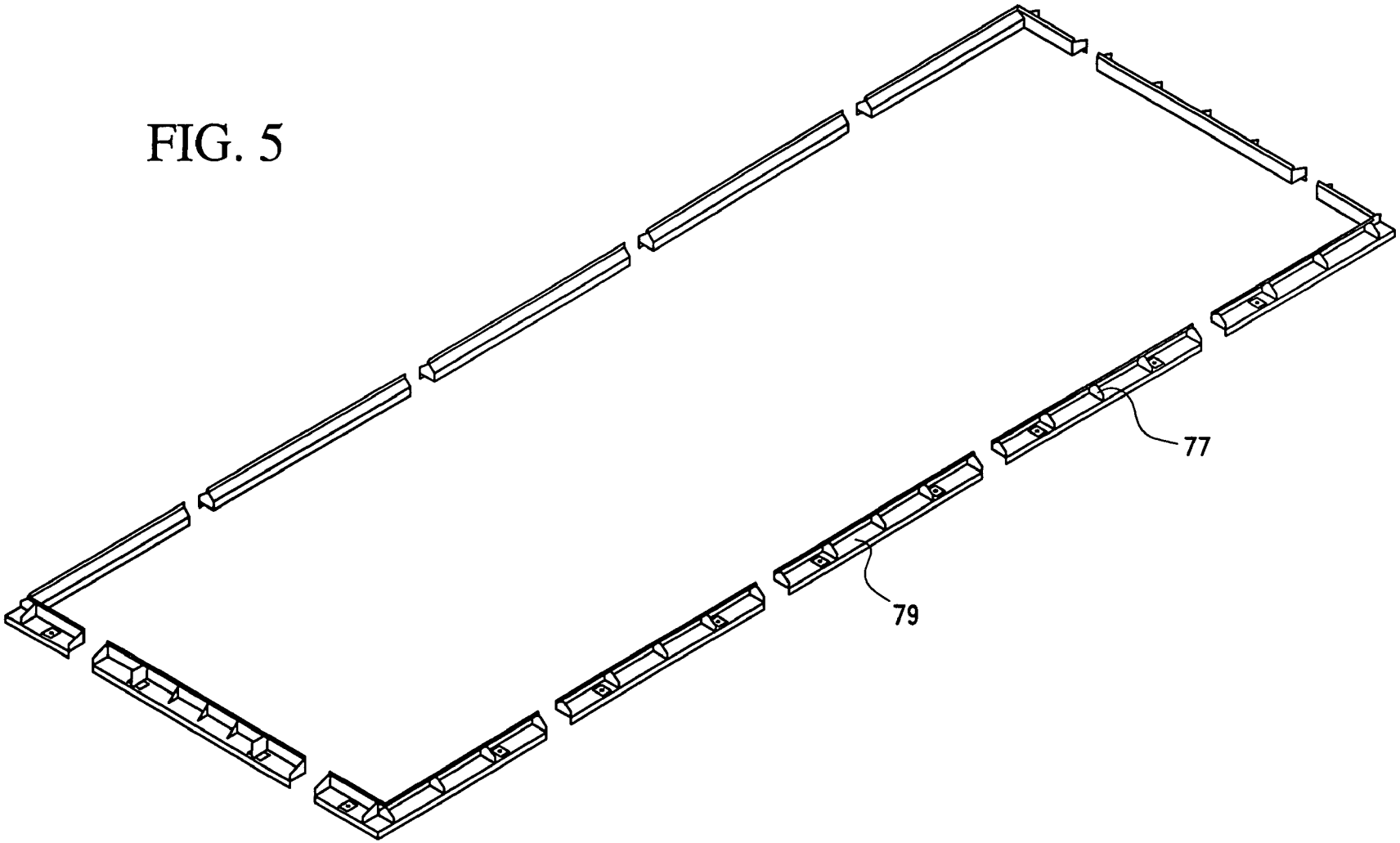
FIG. 5 is a pictorial view of the cover for the base form when no sand catcher is utilized.

When the base form 21 is used without a sand catcher 75, a cap 77 is placed over the top of each support member 37, as can be seen in FIG. 3 and in FIG. 5. The cap 77, as best seen in FIG. 5, has a cap base 79, which is secured to the base form 21. The inside cap wall 31, which faces the sand area 33, extends generally vertically upwardly and then slopes upwardly at an acute angle away from the sand area 33. This sloping of the cap 77 provides a support surface 83 for a cover 85 over the sand area 33.

An outside cap wall 87 (FIG. 3) slopes downwardly from the inside cap wall 81 and then extends vertically downwardly to the top of the outside wall 35. As best seen in FIG. 5, the outside cap wall 87 is a flat member 88 placed on the cap base 79. The outside cap wall 87 provides strength to the cap 77. A synthetic track surface 89 (FIG. 3) may abut the cover 85 above the support surface 83.

Figure 6:
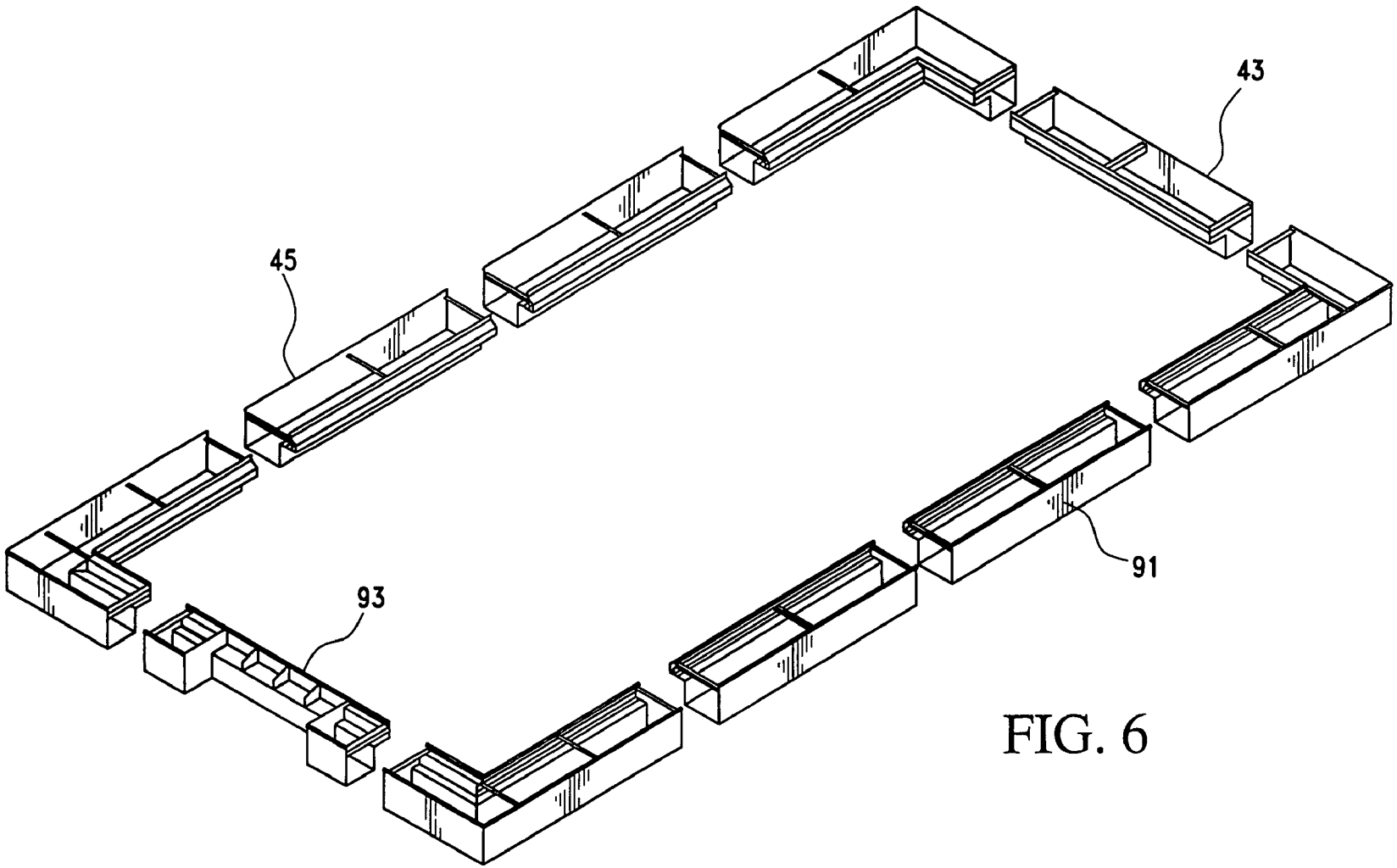
FIG. 6 is a sectional pictorial view of the sand catcher.
Figure 7:
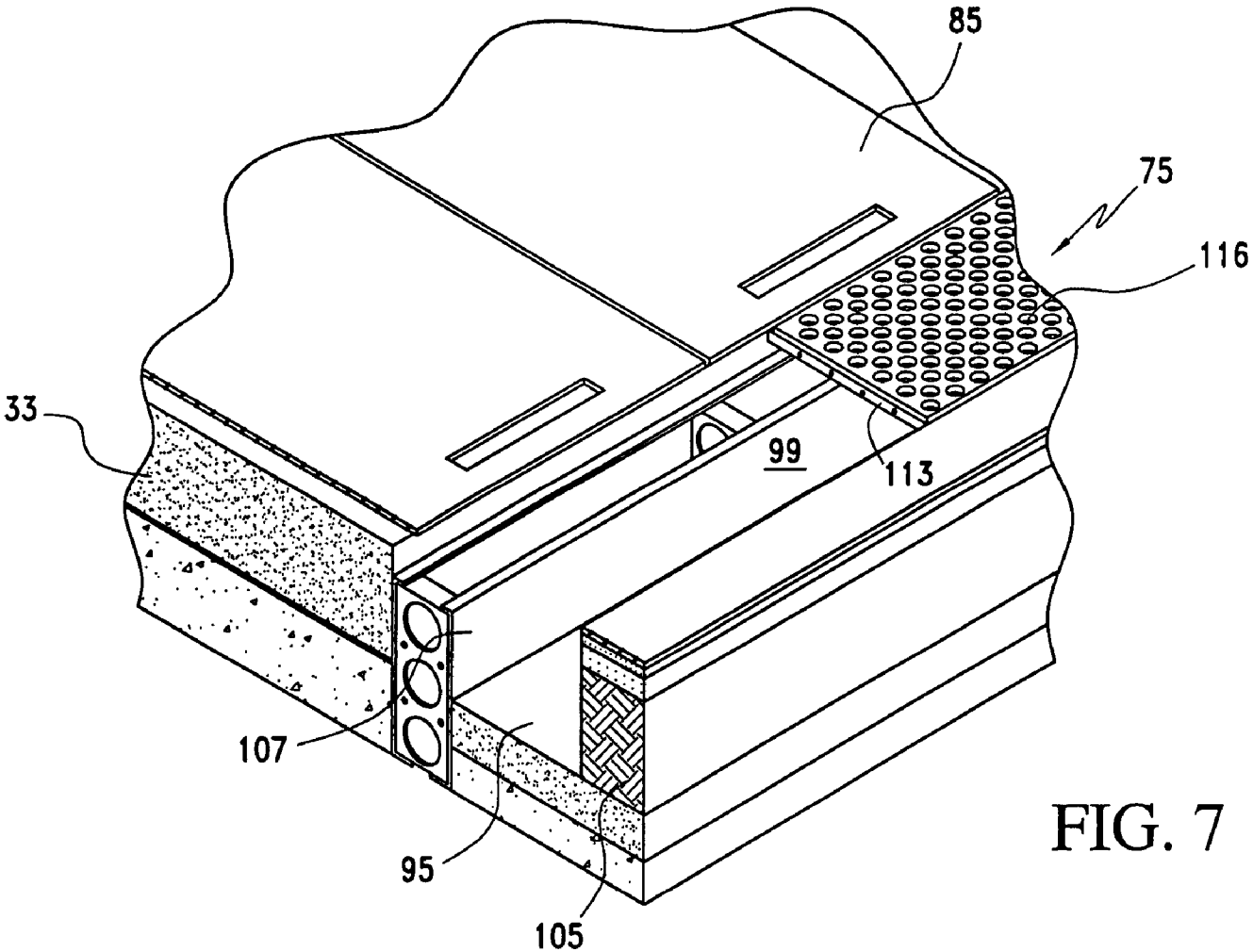
FIG. 7 is a pictorial view showing the base form with a sand catcher.
Figure 8:
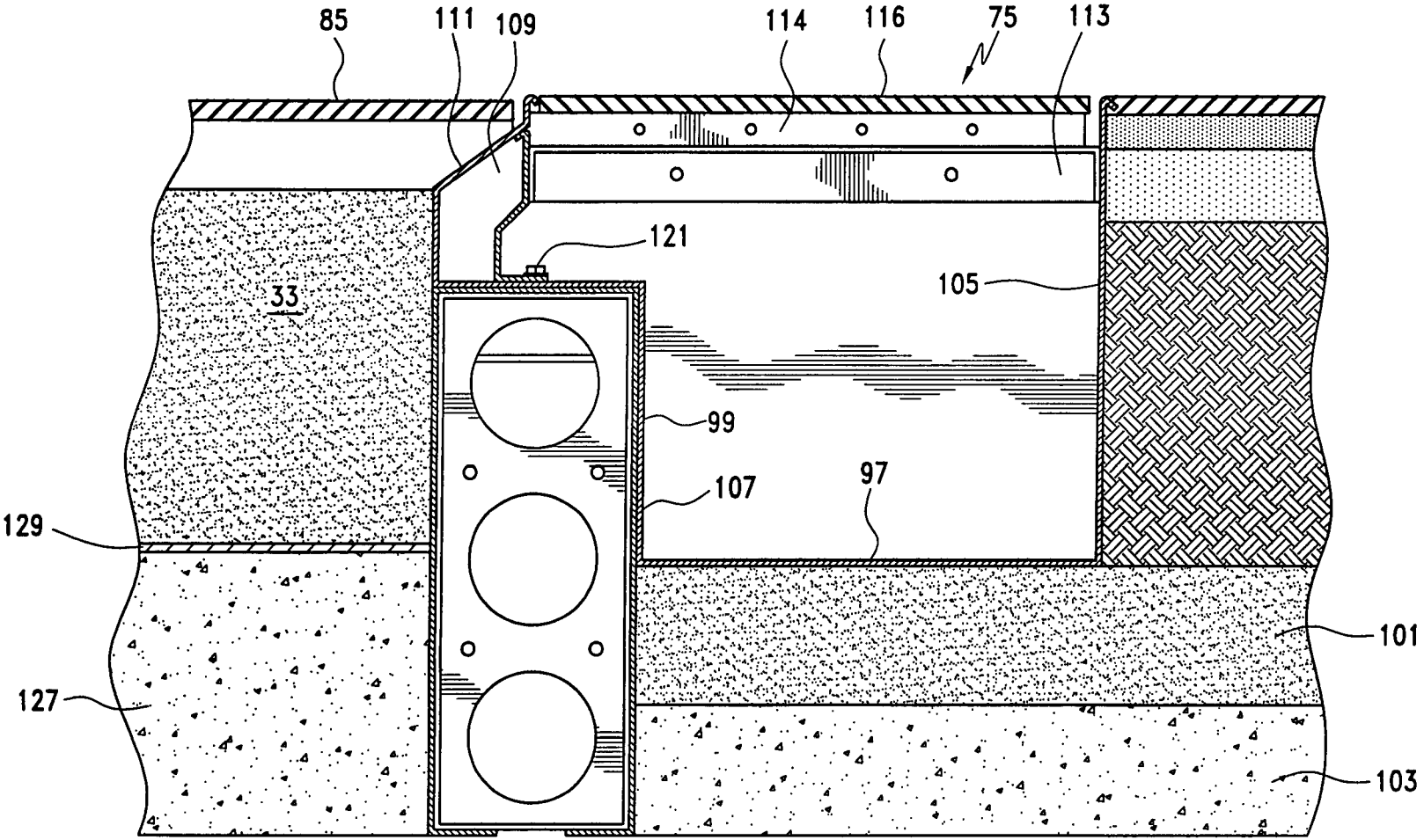
FIG. 8 is a cross-sectional view of the base form with a sand catcher.

As has been previously stated, a jump pit is best provided with a sand catcher 75. The construction of the base form 21 remains the same as previously described. As best seen in FIG. 6, the sand catcher 75 is also made in catcher sections 91, which are secured together, at the site of installation. The sand catcher 75, surrounds most of the sand area 33, but not necessarily all of the sand area 33. Since a jump pit is situated so that a jumper will approach the jump pit from one direction, the jumper lands in the jump pit so as to throw sand from the jump pit over certain sections. For this reason, a jump pit has the sand catcher 75 along three of the four sides, 43, 45, as seen in FIG. 6.

Referring now to FIG. 6, one short side 43 does not include a sand catcher 75. All of the other three sides 43,45 does include a sand catcher 75. The one short side 43, not having a sand catcher 75, includes a wall cap 93, used where no sand catcher 75 exists, as previously described. When the sand catcher 75 is used, the cap 77, is previously described, is not used. The sand catcher 75 includes a chamber 95 with a partial cap 109 on the support members 37. The chamber 95 has a rectangular cross-section with a horizontal bottom 97, and two vertical enclosures 99 extending from the horizontal bottom 97. The horizontal bottom 97 is generally aligned with the vertical center of each of the support members 37. The chamber 95, rests upon compacted sand 101 placed upon crushed stone 103.

The two vertical enclosures 99, include an outside enclosure 105 remote from the sand area 33, and an inside enclosure 107 adjacent to the support members 37. The inside enclosure 107 extends across the top of the support members 33 thereby covering the support members 33. A partial cap 109 is placed on the top 29 of the support members 33. The partial cap 109 has an inclined surface 111 to retain a cover 85 over the sand area 33, as was previously described for the cap 77. The partial cap 109 also, is secured to braces 113, which extend across the sand catcher 75 and is secured at its opposite end to the outside vertical enclosure 105. The braces 113 are located (FIG. 6) at both ends of each catcher section 91 and at the center of each catcher section 91.

A grate 114, preferably made of aluminum, is supported by braces 113. A mat 116 preferably of a rubber composition is placed over the grate 114. The grate 114 and the mat 116, have openings through them to permit sand to pass through them and then to drop into the chamber 95. A bolt 121 secures the partial cap 109 to the inside enclosure 107.

Beneath the sand area 33, either with a sand catcher 75 or without a sand catcher 75, there is crushed stone 127 with a thin layer of Geotextile 129 between the crushed stone and the sand in the sand area 33.

It to be understood that the drawings and description matter are in all cases to be interpreted as merely illustrative of the principles of the invention, rather than as limiting the same in anyway, since it's contemplated that various elements to achieve like results without departing from the spirit of the invention or the scope of the appending claims.

The invention claimed is:

1. A jump pit form for constructing a jump pit with a sand area comprising:

a base form having an inside wall and an outside wall and support members located between the outside wall and the inside wall;

a cap mounted on the support members, the cap having an inclined surface; and a cover over the sand area supported by the inclined surface.

2. A jump pit form according to claim 1 further including a chamber adjacent the inside wall.

3. A jump pit form according to claim 1 further including:

a chamber adjacent the outside wall;

a grate covering the chamber;

a brace supporting the grate; and a mat over the grate.

4. A jump pit form according to claim 1 wherein each support member has a cross member and has an inside panel at right angles to the cross member and has an outside panel substantially at right angles to the cross member, the inside panel and the outside panel being substantially parallel to one another.

5. A jump pit according to claim 1 further including a chamber adjacent the outside wall and wherein the chamber has a rectangular cross section.

6. A jump pit form for constructing a jump pit with a sand area comprising;

a base form including a plurality of sections, each section having an inside wall and an outside wall and support members located between the outside wall and the inside wall and having an outside panel and an inside panel both at right angles to the cross panel and having a base panel substantially at right angles to the cross member and also, being at generally at right angles to both the inside panel and the outside panel;

means to connect the plurality of sections together;

a cap mounted on the support members, the cap having an upper surface which slopes upwardly and away from the inside wall toward the outer wall forming an inclined surface and then slopes downwardly toward the outside wall;

a cover supported by the inclined surface of the cap;

a chamber adjacent to the support member, the chamber having a base and a top;

a brace located adjacent to top;

a grate supported by the brace; and a mat being mounted on the grate, both the grate and the mat having openings through them.

7. A jump pit form according to claim 6 wherein both the outside wall and the inside wall have a top and a bottom, the top and the bottom being generally parallel to one another.

8. A jump pit form according to claim 6 wherein the outside panel and the inside panel are substantially at right angles to the cross panel.

9. A jump pit according to claim 6 wherein the outside panel and the inside panel are substantially at right angles to the cross panel.

10. A jump pit according to claim 6 wherein the outside panel and the inside panel are substantially at right angles to the cross panel and wherein the base panel is substantially at right angles to the cross member and is generally at right angles to both the inside panel and the outside panel.

11. A jump pit form according to claim 6 wherein the chamber has a rectangular cross section.

12. A jump pit form according to claim 6 wherein:

both the outside wall and the inside wall of the base form includes a top part and a bottom part, the top and the bottom and being generally parallel to one another, the support members being secured to the inside wall and the outside wall, each support member having a cross member extending from the inside panel to the outside panel, and substantially at right angles to the inside wall and the outside wall, the inside panel and the outside panel being substantially parallel to one another.

13. A jump pit according to claim 12 wherein the cross section has three large circular openings through it.

14. A jump pit form according to claim 12 wherein the cross member has a rectangular cross section.

* * * * *